US005203046A

United States Patent [19]

Shaw

[11] Patent Number: 5,203,046

[45] Date of Patent: Apr. 20, 1993

[54] FLOOR BUFFING MACHINE

[76] Inventor: Patrick A. Shaw, 4359 Victory Dr., Kansas City, Kans. 66102

[21] Appl. No.: 734,143

[22] Filed: Jul. 22, 1991

[51] Int. Cl.[5] ..... A47L 11/14

[52] U.S. Cl. ..... 15/98; 15/49.1; 51/177

[58] Field of Search ..... 15/49.1, 50.1, 50.2, 15/50.3, 52.1, 52.9, 98, 340.2; 51/174–177; 299/39, 41

[56] References Cited

U.S. PATENT DOCUMENTS

| | | | |
|---|---|---|---|
| 3,921,244 | 11/1975 | Warren et al. | 15/98 |
| 3,977,421 | 8/1976 | Fallen | 15/98 |
| 4,059,863 | 11/1977 | Deuchar | 15/98 |
| 4,115,890 | 9/1978 | Burgoon | 15/49.1 |
| 4,608,727 | 9/1986 | Schwab | 15/49.1 |
| 4,888,843 | 12/1989 | Smith et al. | 15/98 |

FOREIGN PATENT DOCUMENTS

| | | | |
|---|---|---|---|
| 0182178 | 5/1986 | European Pat. Off. | 15/98 |

*Primary Examiner*—Edward L. Roberts

*Attorney, Agent, or Firm*—Kokjer, Kircher, Bowman & Johnson

[57] ABSTRACT

A floor buffing machine powered by a propane engine has a frusto-conical shield and an integral inverted channel extending rearwardly from the shield to provide a mounting deck for the engine and propane fuel tank. A buffing pad is rotated by the engine through a drive train and is carried on an inclined spindle having a flexible connection with the spindle. The incline of the spindle and the flexible construction of the connection causes the rearwardly moving side of the buffing pad to propel the machine forwardly.

19 Claims, 3 Drawing Sheets

FLOOR BUFFING MACHINE

BACKGROUND AND SUMMARY OF THE INVENTION

This invention relates in general to the cleaning of floors and more particularly to an engine powered floor buffing machine that is used for the cleaning of large floor surfaces.

Supermarkets, large department stores and other buildings that have large floor surfaces require frequent and regular cleaning of their floors, especially when the floors receive public foot traffic. Although electric powered floor buffers can be used on smaller floors, the buffers that are normally used for commercial purposes to clean larger floors are powered by propane engines or other internal combustion engines. The buffer must often travel down one long aisle and return along the next aisle, and electric machinery is unsuitable for this type of application for a number of reasons.

The engine powered buffers that have been available in the past are not entirely satisfactory in all respects. Perhaps most notably, they are heavy and bulky machines that the operator has difficulty in maneuvering in a manner to effectively buff all areas of the floor and particularly corner areas and areas that extend along walls or other barriers. Also, small engines of practical size and weight are usually air-cooled, and due to the combustion properties of propane engines, overtemperature often leads to the need for expensive repairs. In addition to the engine, the machine must be equipped with a propane tank and also with a battery for supplying electrical power to the starting system and other electrical components. Arranging these large components in a compact configuration without reducing their ability to function effectively has long been a difficult problem. The fuel tank is typically strapped in place behind the axle where its mass partially counter balances that of the engine. This leaves as the only available place for the battery the area behind the fuel tank. However, mounting the engine, fuel tank and battery one behind the other creates a machine that has considerable length, and its turning radius is reduced accordingly. Another problem is that when the machine is tilted back to expose the buffing pad for pad changing, the battery is also tilted and acid can leak from it.

Existing floor buffing machines typically house the circular buffing pad within a flat, circular shield. Mounted on the shield is a box structure providing a platform on which the engine, fuel tank and battery are mounted. This type of configuration requires relatively thick gage sheet metal in order to provide enough strength to bear the weight of the machine components. The need for thick gage sheet metal increases both the weight of the machine and the cost.

Another problem is that the operator must push and guide the machine, and this can lead to operator fatigue. The flexible fuel lines that ar used are susceptible to rupture and other leaks that can create dangerous situations. It is also common for operators to leave the machine running unattended, and this creates additional safety problems.

SUMMARY OF THE INVENTION

The present invention is directed to an improved floor buffing machine which reduces many of the problems that have plagued prior machines. The machine of the present invention is characterized by a one-piece body which takes the form of a truncated conical shield having an integral channel section extending to the rear to provide a mounting platform for the engine and fuel tank. This construction exhibits inherent structural strength because of the strength of the truncated cone and the fact that the channel section has inclined panels and vertical skirts which cooperate to enhance the rigidity and stiffness of the structure. At the same time, the unusual shape exhibits considerable aesthetic appeal.

The engine is equipped with a conventional gasoline carburetor adapted to gaseous fuel. In addition, a small tank containing distilled water is mounted below a water discharge nozzle which is inserted in the carburetor venturi. At engine operating speed, the venturi vacuum is a function of the air velocity, which is a function of the throttle angle. The throttle angle is such that the venturi action functions to maintain consistent speed. At operating load, sufficient vacuum is generated to cause water to flow through the hose, an adjustable metering jet, and the discharge nozzle. Distilled water is ingested with the Propane-Q mixture in the form of a fine mist. This mist cools the combustion chamber by vaporization into steam, which then assists the ignited fuel-air change in driving the piston and the drive train.

It is a particular feature of the invention that the buffer pad mounting arrangement and the drive train are specially arranged to provide self-propulsion which reduces operator fatigue and to resist torque which can create a strain on the operator. The spindle that carries the upper pad is cocked or skewed at an incline to one side so that the rearwardly moving side edge of the pad is slightly lower than the other edge. A flexible coupling between the spindle and the pad allows the pad to level out and fully contact the floor in order to buff all areas of the floor equally. At the same time, the flexure of the coupling causes the rearwardly moving side of the pad to apply more pressure to the floor than the forwardly moving side. Consequently, a net forward force is provided by the pad in order to propel the machine forwardly in a controlled fashion. At the same time, the machine exhibits resistance to torque as a result of the skewed spindle, and there is no tendency for the leading part of the pad to "dig in" to the surface and thus create difficulty for the operator.

The battery is mounted above the fuel tank so that excessive extension of the machine to the rear is avoided, thus reducing the overall length of the machine and enhancing its maneuverability and particularly its ability to move down one wall and make a right angle turn at a corner area and then move along the adjacent wall. The battery also has a self-leveling mounting arrangement which permits it to pivot about a horizontal axis in order to maintain a level or upright posture even when the machine is tilted fully back. This eliminates the leakage of battery fluids that has been a problem in the past.

The machine is provided with a unique control system which includes normally open switches on both of the hand grips. At least one of the hand grip switches must be depressed in order to permit the engine to run. Consequently, whenever the operator releases both handle bars, the engine stops immediately. Automatic engine shut-off is effected by providing a solenoid fuel valve in the fuel line that is closed unless one of the hand grip switches is depressed. It is a particular feature of the invention that the fuel valve is located upstream from all flexible parts of the fuel line. Therefore, if the fuel line should rupture, the operator can simply release both handles and the fuel valve will then close at a location upstream from the rupture to avoid the discharge of flammable gas.

The invention is further characterized by another safety feature that involves the provision of an arm switch that must be purposely closed before the machine can operate. Additionally, indicator lights are provided to tell the operator the condition of the various switches, and a uniquely arranged starting system is provided for safely and conveniently starting the engine.

Other and further objects of the invention, together with the features of novelty appurtenant thereto, will appear in the course of the following description.

DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 1:
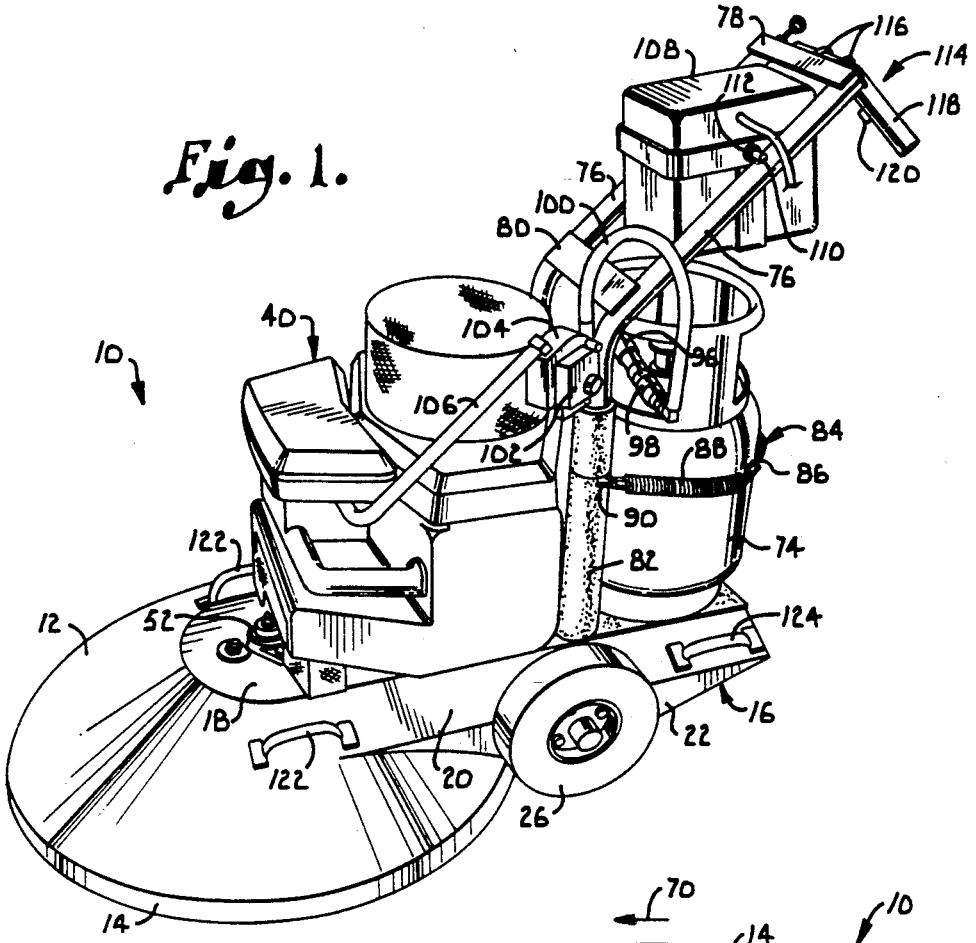
FIG. 1 is a perspective view of a floor buffing machine constructed according to a preferred embodiment of the present invention.

Referring now to the drawings in more detail, numeral 10 generally designates a floor buffing machine constructed in accordance with the present invention. The machine includes as part of its main structural frame or body a specially constructed shield 12 having the shape of a truncated cone. The shield 12 is constructed of sheet material, and its circular lower edge is equipped with a downwardly projecting skirt 14. Formed integrally with and extending rearwardly from the frusto-conical shield 12 is an inverted channel section which is generally identified by numeral 16. The channel section 16 is constructed of the same sheet material as the shield 12. The central top portion of the shield 12 and the top of the channel 16 cooperate to provide a horizontal platform or deck 18 on which various components of the machine are mounted, as will be explained more fully.

Figure 2:
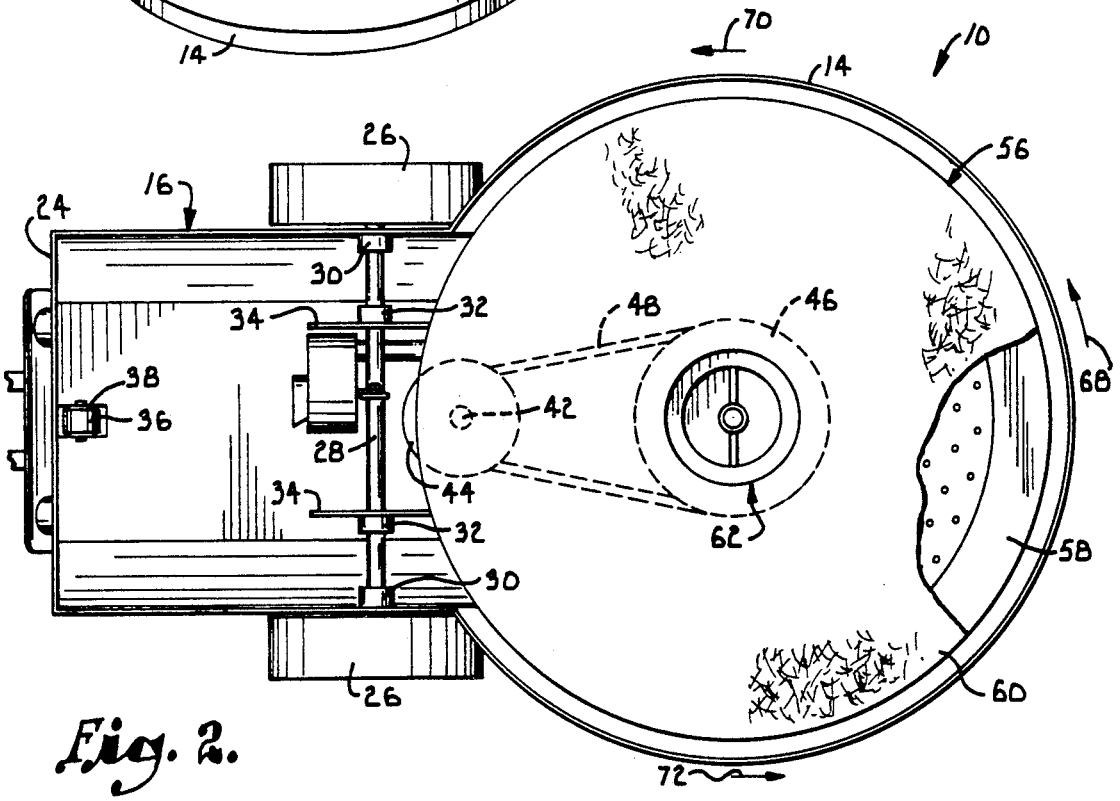
FIG. 2 is a bottom plan view of the machine on an enlarged scale, with a portion of the buffing pad broken away for purpose of illustration.

Extending downwardly and outwardly from the deck 18 are inclined side panels 20 located on opposite sides of the channel 16. Extending downwardly from the lower edge of each inclined panel 20 is a vertical side skirt 22. The front portions of the skirts 22 merge at their lower edges with the conical surface of the shield 12, while the rear portions of the skirts 22 are tapered toward the back of the machine. As best shown in FIG. 2, a downwardly turned flange 24 extends between the inclined panels 20 on the back of channel 16. The shield 12 and channel 16 are open at the bottom and together form the main structural frame or body of the machine 10.

The body of the machine is mounted on a pair of wheels 26 for rolling movement along a floor or other surface that is to be buffed by the machine. As best shown in FIG. 2, the wheels 26 are mounted on opposite sides of the channel 16 on a axle 28 which extends through collars 30 mounted on the opposite side skirts 22 and through additional collars 32 mounted on plates 34 which extend downwardly from the deck 18. A third and smaller wheel 36 is mounted on a bracket 38 located adjacent to the back flange 24 of channel 16. Wheel 36 is supported for rotation on the bracket 38 and projects below the lower edges of the side skirts 22 at the transverse center of the machine.

Figure 3:
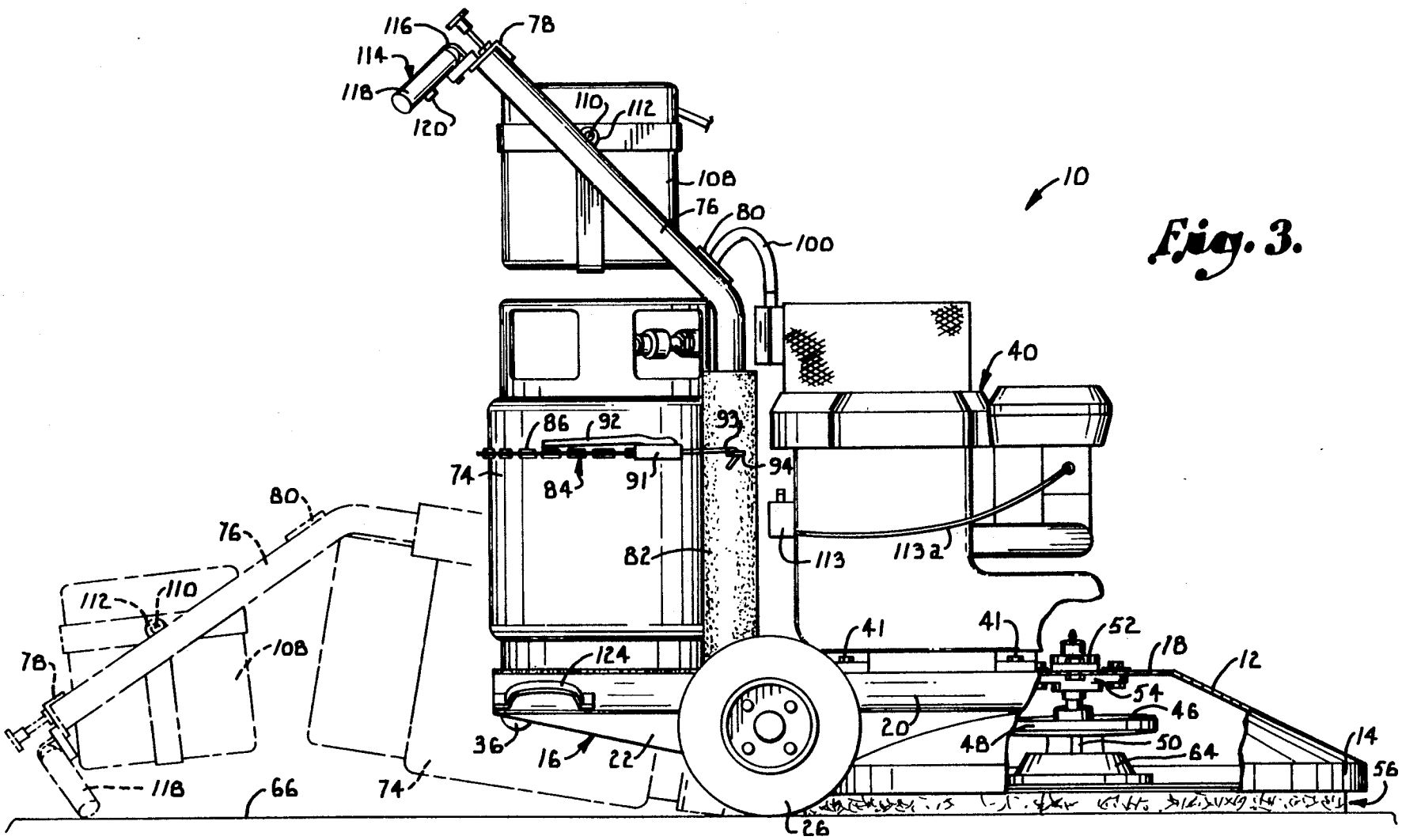
FIG. 3 is a side elevational view of the floor buffing machine, with portions broken away for purposes of illustration and the broken lines illustrating the machine tilted backwardly to expose the buffing pad for pad changing or other servicing.

An internal combustion propane engine 40 is mounted on the front portion of the deck 18 and is secured to the deck by bolts 41 (see FIG. 3). As shown in FIG. 2, the engine 40 drives a rotary output shaft 42 which extends vertically through the deck 18 and carries a drive pulley 44 beneath the platform. A driven pulley 46 receives a flexible v-belt 48 which is also drawn around the drive pulley 44. Pulley 46 is carried on a spindle 50 (FIG. 3) which is supported for rotation by a pair of bearings 52 and 54 mounted to the platform 18 on its top side and underside, respectively. The drive belt 48 transfers rotation from pulley 44 to pulley 46 and thus rotates the spindle 50 when the engine 40 is operating.

It is an important feature of the invention that the spindle 50 is inclined to one side and forwardly from top to bottom. As viewed from behind, the incline of the spindle 50 from top to bottom is toward the left side of the machine and to the front. In order to achieve this cocking or skewing of the spindle 50, the bearings 52 and 54 are canted appropriately. The skewing of the spindle 50 is relatively slight so that there is no impairment of the transmission of power between the pulleys 44 and 46.

A buffing pad or wheel which is generally identified by numeral 56 is driven rotatively by the engine 40 through the drive train previously described. The buffing wheel 56 includes a circular buffing disk 58 (see FIG. 2) which carries a removable buffing cloth or pad 60. The cloth or pad 60 is held on the disk 58 by a releasable fastener 62 which permits the pad 60 to be replaced by a different pad if desired.

The disk 58 is secured to the spindle 50 by a flexible coupling 64 (FIG. 3). The flexible coupling 64 mounts the disk 58 for rotation with spindle 50 while permitting the disk to flex about the inclined axis of the spindle 50. The bottom surface of the buffing pad 60 projects well below the lower edge of the flange 14 so t hat the buffing pad is able to contact the surface of the floor 66, as best shown in FIG. 3. Although the axis of the spindle 50 is inclined from vertical, the flexibility of the coupling 64 permits the lower surface of the buffing pad 60 to flatly contact the floor 66. The spindle 50 is substantially centered on the longitudinal cone axis of the frusto-conical deck 12, although the cone axis is vertical and the spindle axis is inclined slightly from vertical. The engine 40 rotates wheel 56 in the direction indicated by the directional arrow 68 in FIG. 2. It is thus evident that when viewed from behind the machine, the right edge portion of the pad 56 moves rearwardly while the opposite or left edge portion of the pad moves forwardly, as indicated by the respective arrows 70 and 72 in FIG. 2.

The propane fuel which is burned by the engine 40 is supplied by a propane tank 74 which is mounted on the back end of the platform 18 at a location immediately behind the engine 40. Secured to and extending upwardly from the platform 18 are a pair of parallel tubular bars 76 located generally above the axle 28. The bars 76 are bent to the rear on their upper portions and are connected at their upper ends by an angle bracket 78. A cross-brace 80 is secured between the two bars 76 at a location immediately above the bent portions of the bars. The vertical portions of the bars 76 are provided with sleeves 82 which are constructed of foam or another material serving as a cushion.

The propane tank 74 is secured to the bars 76 and retained in place on the platform 18 by a flexible retainer which is generally identified by numeral 84 and which includes a flexible chain 86 and a tension spring 88 secured end to end. One end of the spring 88 is looped through an eye 90 (FIG. 1) which extends from one of the bars 76. The opposite end of the spring 88 is hooked to the chain 86. As shown in FIG. 3, the opposite end of the chain 86 is equipped with a releasable latch 91 having a pivotal, overcenter type handle 92 that performs the latching and unlatching functions. Extending from the latch 91 is a hook 93 which may be hooked through an eye 94 extending from the other bar 76. A cross brace (not shown) extends between the bars 76 adjacent the eyes 90 and 94 to resist the force of the chain and spring, and this brace is suitably connected to the engine block.

The handle 92 may be pivoted between latched and unlatched positions of the latch 91. In the unlatched position, the flexible retainer 84 may be loosely drawn around the propane tank 74, and the hook 93 may be hooked through the eye 94 with the retainer in a loose condition. The handle 92 can then be swung to the overcenter latched position, and this draws the retainer 84 to a tight condition in which the tension spring 88 is stretched, thereby applying a force that holds the retainer 84 in a taut condition in order to securely hold the propane tank 74 in place on the platform 18. The tank 74 may be removed for refilling or servicing by swinging the handle 92 to the unlatched condition and then unhooking the hook 93 from the eye 94 to release the retainer 84 from the tank.

Extending from the propane tank 74 to the engine 40 is a fuel line which includes a conventional threaded fitting 96 that may be threaded onto a mating fitting on the tank 74. Adjacent to the fitting 96 is a combined fuel filter and solenoid valve 98. The solenoid valve 98 is normally closed but which can be opened by energizing its control solenoid, as will be explained more fully. The fuel filter connects with a u-shaped fuel line 100 that extends to a pressure regulator 102 which regulates the pressure of the gas flowing through the fuel line. Extending between the regulation 102 and the engine 40 is a flexible hose 106 which forms part of the fuel line and which leads to the fuel intake of the engine 40. A vacuum valve 104 is included in the fuel delivery system.

A conventional wet cell rechargeable battery 108 (12 volts) is mounted between the inclined upper end portions of the tubular bars 76 at a location immediately above the propane tank 74. The battery 108 is provided with a pair of axially aligned sleeves 112 which project from its opposite sides. The sleeves 112 are received for pivotal movement in stub shafts 110 mounted on the respective bars 76. By reason of this mounting arrangement, the battery 108 is mounted to freely pivot about the horizontal axis provided by the aligned stub shafts 110. It is noted that the sleeves 112 are located well above the center of gravity of the battery so that the battery automatically remains in a level or upright posture as the machine is tilted back and forth toward and away from the inclined position shown in broken lines in FIG. 3. By virtue of the pivotal mounting of the battery 108, it is able to remain upright so that battery acid is unable to leak from it as the machine is tilted back and forth.

A small tank 113 (FIG. 3) containing distilled water is mounted on the back of the engine 40 at a location below a discharge nozzle (not shown) which is inserted in the venturi of the carburetor and which connects with the end of a water line 113 extending from the tank 113. When the engine reaches operating speed, the engine vacuum draws distilled water from tank 113 through the water line **113*a* and injects it through an adjustable metering jet (not shown) and the nozzle on line 113*a***. The water is drawn into the venturi in the form of a fine mist which vaporizes and cools the combustion chamber and also assists the fuel-air charge in driving the piston and other parts of the drive train.

A handlebar which is generally identified by numeral 114 is secured to the angle bracket 78 by a pair of u-shaped clamps 116. The opposite ends of the handlebar 114 provide a pair of projecting hand grips 118 which may be conveniently gripped by the respective hands of the operator of the machine. Each hand grip 118 is provided with a manually actuated switch 120 which projects from the bottom of the hand grip at a location to be depressed by the fingers of an operator having the grip 118 in his hand. Each switch 120 is a normally open switch urged toward an extended position which is an open position of the switch, and the switches can be depressed by the fingers to the closed position, as will be more fully explained.

A pair of front handles 122 are provided on opposite sides of the deck 12. The inclined panels 22 are likewise each provided with a back handle 124. The handles 122 and 124 facilitate lifting and carrying of the machine 10.

Figure 4:
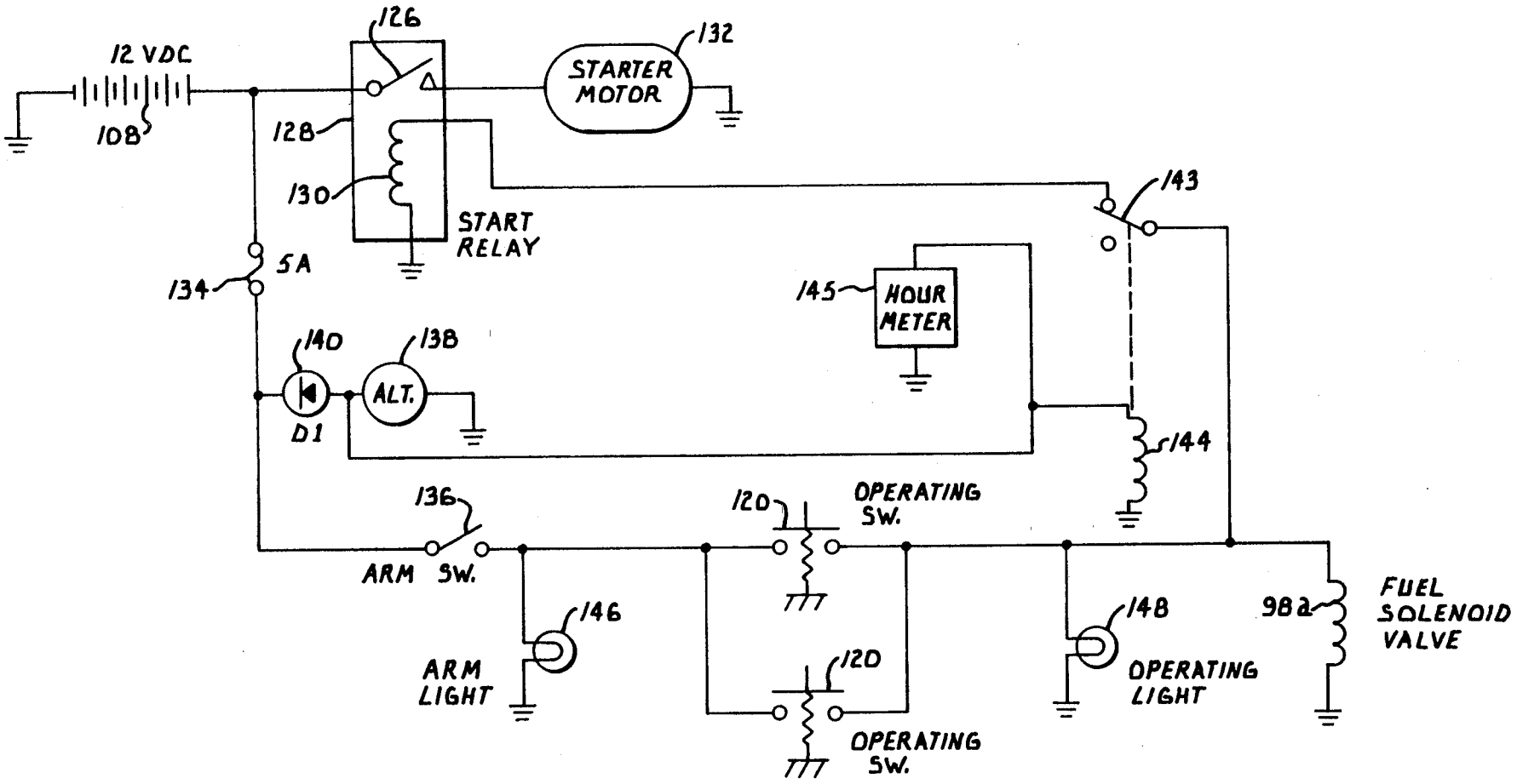
FIG. 4 is a schematic diagram of the electrical system of the floor buffing machine.

FIG. 4 is a schematic diagram of the electrical system of the machine 10. The battery 108 connects on its positive side with the relay contacts 126 of a relay 128 having a coil 130 that may be energized to close the relay contacts 126. An electric starter motor 132 for the engine 40 connects with the opposite side of the relay contacts 126 and is thus energized whenever the relay is energized. When the starter motor 132 is energized, it serves to start the engine 40.

The solenoid valve 98 has its solenoid **98*a* arranged in a circuit that extends from the positive side of the battery 108 through a fuse 134, a normally open arm switch 136 and the two operating switches 120 connected in parallel with one another. The positive line of the battery is also connected with a conventional alternator 138 through a diode 140. The alternator 138 is driven by the engine 40. The start relay coil 130 is connected in parallel with the solenoid 98*a* through relay contacts 143 controlled by a relay coil 144. The contacts 143 are in the position shown in FIG. 4 when the engine is idle, thus allowing current to be supplied to the start relay 130. However, when the engine is in operation, the alternator 138 energizes relay coil 144 which then opens the contacts 143. An hour meter 145 is activated by the current supplied to it by the alternator 138 whenever the engine is in operation. The hour meter 145** monitors the time of operation of the engine and thus keeps track of the operating time of the machine.

An indicator light 146 is energized whenever the arm switch 136 is closed, and the light 146 thus provides a visual indication that the system is armed due to closure of the arm switch 136. Another indicator light 148 is arranged in parallel with the solenoid 98*a* and is thus energized whenever the solenoid is energized. It is noted that the arm switch 136 and at least one of the operating switches 120 must be closed in order to energize the solenoid 98*a* and the operating light 148. Preferably, the arm switch 136 and the indicator lights 146 and 148 are mounted on the top face of the angle bracket 78.

In use, the engine 40 is started by closing the arm switch 136 and then tilting the bars 76 to the rear in order to raise the buffing wheel 56 above the floor. Depression of one or both of the operating switches 120 then completes the circuit to the relay coil 130, and this in turn closes the relay contacts 126 to energize the starter motor 132. At the same time, the solenoid 98*a* is energized so that the solenoid fuel valve 98 is opened to supply propane through the fuel line to the engine 40. The starter motor starts the engine 40, and the contacts 43 are switched by the coil 144 (energized by the alternator) to interrupt the circuit to the relay coil 130 once the engine is in operation. This in turn deenergizes the starter motor 132 by opening the relay contacts 126.

With the arm switch 136 closed, the solenoid 98*a* remains energized so long as one or both of the operating switches 120 remains closed. The operator can then tilt the machine forwardly so that the buffer pad 60 flatly contacts the floor 66, and the buffer pad effects buffing of the floor as it is rotated by the engine 40 and the drive train which connects the engine with the buffing pad.

As previously indicated, the skewed orientation of the spindle 50 requires that the flexible coupling 64 flexed to one side in order to permit the buffing pad 60 to flatly contact the floor. The coupling 64 resists this flexure and naturally exerts a force in opposition to it. Consequently, the tendency of the flexible coupling 64 to unflex causes the right side portion of the buffing pad 60 to be pushed against the floor 66 more forcefully than the left side portion of the buffing pad. Because the right side portion of the buffing pad is moving rearwardly due to the direction of rotation of the buffing pad, the net force applied to the floor by the buffing pad is to the rear, and this force propels the machine slowly forwardly in a manner that can easily be controlled by the operator. Also, the torque force is cancelled by the skewed spindle and the rear part of the pad engages the floor more forcefully than the front part so that any tendency for the front of the pad to dig in is eliminated.

The operator walks behind the machine as its advances forwardly to buff the floor, and his hands remain on the grips 118 to steer the machine and keep the operating switches 120 depressed. Because the machine 10 is relatively short from front to back and also because of its overall compact configuration, the machine is able to make sharp turns in order to follow unusual contours, including 90° corners at the intersection between two walls. As a consequence, the machine is able to effectively and thoroughly buff the floor surface.

Because the switches 120 automatically open whenever they are released, the machine cannot be left running unattended, as opening of both switches 120 interrupts the circuit to the solenoid 98*a* and thus results in closing of the solenoid valve 98 to interrupt the supply of fuel to the engine 40. The location of the solenoid valve 104 upstream from the flexible fuel lines 100 and 106 also provides safety. If either flexible fuel line 100 or 106 should rupture or otherwise leak, the operator can release the hand grips 118, and the switches 120 then open to effect closing of the solenoid valve 98 at a location upstream from the fuel leak, thus preventing the propane from discharging through the leak and creating a dangerous situation. The provision of the normally open switches 120 on the hand grips requires operator presence both to start the engine 40 and to keep the engine running.

The unique configuration of the shield 12 and the integral channel 16 provides a strong frame for the machine also provides it with aesthetic appeal. The frusto-conical shape of the shield 12 is inherently stronger than a circular shield with a flat top, and the formation of the channel section 16 integrally with the shield provides both structural integrity and cost savings.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, I claim:

1. A floor buffing machine comprising:

a body having a truncated conical shield constructed of sheet material and a channel section integrally joined to and extending in a rearwardly direction from said shield, said channel section having a generally horizontal deck partially overlying said shield and opposite side panels;

an engine mounted on said deck, said engine driving an output shaft;

a fuel tank mounted on said deck behind the engine and holding fuel for combustion in the engine;

releasable means for retaining said fuel tank on the deck;

a battery for supplying electrical power;

means for mounting said battery at a location above the fuel tank in a manner permitting the battery to pivot about a substantially horizontal pivot axis to maintain the battery in a generally level orientation;

a buffing disk supported beneath said shield for rotation about a rotational axis substantially coinciding with the major cone axis of said shield;

wheels supporting said body for rolling movement at an elevation to maintain said buffing disk against the floor;

handlebar means connected with said body and located to be grasped by an operator of the machine; and a drive linkage coupling said output shaft with the buffing disk to effect rotation of the disk when the engine operates.

2. The machine of claim 1, wherein each of said side panels comprises an inclined panel extending outwardly and downwardly from said deck and a skirt extending generally downwardly from the inclined panel.

3. The machine of claim 1, wherein said mounting means for the battery comprises:

a pair of spaced apart bar members connecting said handlebar means with the body and extending above the fuel tank; and means for mounting the battery between said bar members for movement about said pivot axis.

4. The machine of claim 1, wherein said releasable means comprises:

an elongate flexible retainer having opposite ends applicable to the machine and a length to be drawn around the fuel tank, said retainer including a tension spring; and a pivotal overcenter latch on said flexible retainer having an unlatched condition wherein the retainer can be drawn loosely around the tank and a latched condition wherein the latch pulls the retainer tautly around the tank with the spring stretched.

5. The machine of claim 1, including:

a fuel line extending from said fuel tank to the engine to deliver fuel therebetween, said fuel line having a flexible portion;

a fuel valve for said flexible portion and having open and closed positions wherein the fuel line is respectively open and closed, said fuel valve having a normally closed position; and switch means for opening said fuel valve whenever the operator is grasping said handlebar means.

6. The machine of claim 1, including:

a spindle on which the buffing disk is mounted, said spindle providing said rotational axis and being inclined to one side from top to bottom to angle said buffing disk from horizontal with one side edge portion of the disk being lower than the opposite side edge portion; and a flexible coupling mounting said buffing disk on the spindle in a manner allowing the disk to skew on the spindle to generally flatly contact the floor with said one side edge portion applying more pressure against the floor than said opposite side edge portion to propel the machine forwardly.

7. The machine of claim 1, including:

a spindle on which the buffing disk is mounted, said spindle providing said rotational axis and being inclined forwardly from top to bottom to angle said buffing disk from horizontal with a rear edge portion of the disk being lower than a front edge portion thereof; and a flexible coupling mounting said buffing disk on the spindle in a manner allowing the disk to skew on the spindle to generally flatly contact the floor with said rear edge portion applying more pressure against the floor than said front edge portion to provide torque resistance.

8. A floor buffing machine comprising:

a frame mounted on wheels to roll along a floor;

handlebar means connected with said frame at a location to be grasped by an operator of the machine;

an engine mounted on said frame, said engine having an output shaft;

a disk shaped buffing pad for application to the floor;

a spindle on which said buffing pad is mounted for rotation about the spindle axis at a location to contact the floor when said wheels roll on the floor, said spindle being inclined to one side from top to bottom to angle said buffing pad from horizontal with one side edge portion of the pad being lower than the opposite side edge portion; and a drive linkage coupling said output shaft with said buffing pad in a manner to rotate the pad in a direction such that said one side edge portion moves from front to back and said opposite side edge portion moves from back to front, said linkage including a flexible coupling which permits the entirety of the pad to contact the floor but which effects more pressure of said one side edge portion than said opposite side edge portion against the floor to propel the machine forwardly.

9. A floor buffing machine comprising:

a frame mounted on wheels for rolling movement along a floor;

a handle structure extending from said frame and including a pair of hand grips located to be gripped by an operator of the machine;

a buffing pad mounted for rotation on the frame at a location to buff the floor;

a fuel burning engine mounted on said frame and coupled with said buffing pad to effect rotation thereof when the engine is in operation;

a fuel tank on the frame for supplying fuel to the engine;

a fuel line extending from said fuel tank to said engine;

a fuel valve in said fuel line having open and closed conditions to respectively open and close the fuel line; and a switch biased toward a normal position wherein said fuel valve is closed and being operable to an actuated position wherein said fuel valve is open, said switch being mounted on one of said hand grips at a location to be operated to the actuated position when the hand of the operator is applied to said one hand grip, whereby when the hand of the operator is removed from said one hand grip, said switch reverts to the normal position to effect closing of the fuel valve to cut off the delivery of fuel to the engine.

10. The machine of claim 9, including:

a battery for supplying electrical power;

a solenoid for effecting the open condition of the fuel valve when energized and the closed condition of the fuel valve when deenergized; and an electric circuit extending from said battery through said switch to said solenoid to effect energization of the solenoid when said switch is closed by the hand of the operator and deenergization of the solenoid when the switch opens upon removal of the hand of the operator therefrom.

11. The machine of claim 10, including a second switch on the other of the hand grips arranged in said circuit in parallel with the first mentioned switch to effect energization of the solenoid whenever either switch is closed.

12. The machine of claim 11, including an arm switch arranged in said circuit in series with said first and second switches to prevent energization of the solenoid unless said arm switch is closed.

13. The machine of claim 10, including:

an electric starter motor for starting the engine;

a second circuit extending to the starter motor from the battery to energize the starter motor upon completion of said second circuit;

a relay operable to complete said second circuit when the relay is energized and to interrupt said second circuit when the relay is deenergized, said relay being arranged in parallel with said solenoid to be energized from the battery when said switch is closed by the hand of the operator; and switch means arranged in series with said relay, said switch means being closed when the engine is idle and opening in response to operation of the engine.

14. The machine of claim 13, including a meter for monitoring the operating time of the engine, said meter being activated whenever the engine is in operation.

15. The machine of claim 10, including an arm switch arranged in said circuit in series with the first mentioned switch to prevent energization of said solenoid unless said arm switch is closed.

16. The machine of claim 15, including a visual indicator for indicating visually when said arm switch is closed.

17. The machine of claim 16, including a second visual indicator for indicating visually when the first mentioned switch is closed while said arm switch is closed.

18. The machine of claim 9, including a second switch biased toward a normal position thereof and mounted on the hand grip opposite said one hand grip to be operated to an actuated position when the hand of the operator is applied to said opposite hand grip, said second switch and the first mentioned switch being arranged to effect opening of the fuel valve when either switch is actuated and to effect closing of the fuel valve when both switches are in the normal position.

19. A floor buffing machine comprising:

a body having a truncated conical shield constructed of sheet material and a channel section integrally joined to and extending in a rearwardly direction from said shield, said channel section having a generally horizontal deck partially overlying said shield and opposite side panels;

an engine mounted on said deck, said engine driving an output shaft;

a buffing disk supported beneath said shield for rotation about a rotational axis substantially coinciding with the major cone axis of said shield;

a spindle on which the buffing disk is mounted, said spindle providing said rotational axis and being inclined forwardly from top to bottom to angle said buffing disk from horizontal with a rear edge portion of the disk being lower than a front edge portion thereof; and a flexible coupling mounting said buffing disk on the spindle in a manner allowing the disk to skew on the spindle to generally flatly contact the floor with said rear edge portion applying more pressure against the floor than said front edge portion to provide torque resistance;

wheels supporting said body for rolling movement at an elevation to maintain said buffing disk against the floor;

handlebar means connected with said body and located to be grasped by an operator of the machine; and a drive linkage coupling said output shaft with the buffing disk to effect rotation of the disk when the engine operates.

* * * * *